US010718099B2

(12) United States Patent
Moradi

(10) Patent No.: US 10,718,099 B2
(45) Date of Patent: Jul. 21, 2020

(54) LEVELING, TUNE-UP AND COMPACTING DEVICE

(71) Applicant: Farzad Moradi, Tehran (IR)

(72) Inventor: Farzad Moradi, Tehran (IR)

( * ) Notice: Subject to any disclaimer, the term of this patent is extended or adjusted under 35 U.S.C. 154(b) by 285 days.

(21) Appl. No.: 15/859,253

(22) Filed: Dec. 29, 2017

(65) Prior Publication Data

US 2018/0142443 A1 May 24, 2018

(51) Int. Cl.

| | |
|---|---|
| ***E02F 3/84*** | (2006.01) |
| ***E02F 9/20*** | (2006.01) |
| ***E02F 9/22*** | (2006.01) |
| ***E02F 9/26*** | (2006.01) |
| ***E02F 7/06*** | (2006.01) |
| ***E02F 3/96*** | (2006.01) |
| ***E02F 5/22*** | (2006.01) |

(52) U.S. Cl.

CPC ..... *E02F 3/842* (2013.01); *E02F 3/961* (2013.01); *E02F 3/967* (2013.01); *E02F 5/226* (2013.01); *E02F 7/06* (2013.01); *E02F 9/2087* (2013.01); *E02F 9/2246* (2013.01); *E02F 9/264* (2013.01); *E02F 9/265* (2013.01); *E02F 9/2045* (2013.01)

(58) Field of Classification Search

CPC . E01C 19/288; E02D 3/00; E02D 3/02; E02F 3/842; E02F 3/961; E02F 3/967; E02F 5/226; E02F 7/06; E02F 9/2087; E02F 9/2246; E02F 9/264; E02F 9/265; E02F 9/2045

See application file for complete search history.

(56) References Cited

U.S. PATENT DOCUMENTS

| | | | | |
|---|---|---|---|---|
| 4,127,351 | A * | 11/1978 | Vural | E02D 3/02 404/133.05 |
| 4,990,025 | A * | 2/1991 | Young | E01C 21/00 404/92 |
| 4,993,316 | A * | 2/1991 | Greer | A01C 1/02 99/487 |
| 5,199,196 | A * | 4/1993 | Straley | E01C 21/00 111/118 |
| 5,511,485 | A * | 4/1996 | Romani | E01B 27/02 104/2 |
| 5,741,085 | A * | 4/1998 | Wirtgen | E01C 23/065 404/75 |
| 5,988,937 | A * | 11/1999 | Komoriya | E02D 3/12 404/90 |
| 6,183,159 | B1 * | 2/2001 | Hashimoto | E02F 5/226 404/76 |
| 6,874,973 | B1 * | 4/2005 | Yoshida | E02D 3/12 37/142.5 |
| 6,971,783 | B2 * | 12/2005 | Owen | E02F 5/226 366/6 |

(Continued)

FOREIGN PATENT DOCUMENTS

JP 2014180770 A * 9/2014

*Primary Examiner* — Abigail A Risic
(74) *Attorney, Agent, or Firm* — Azadeh Saidi

(57) ABSTRACT

A highly efficient embankment machine eliminating the need of using different machinery such as graders, sprinkler trucks and rollers and merging their performances in one single unit; wherein loading, depot of materials, as well as distributing and rigging out materials, water spraying the granules of materials, leveling, tune-up and compacting layers is done with only one machine.

8 Claims, 13 Drawing Sheets

(56) References Cited

U.S. PATENT DOCUMENTS

| | | | | |
|---|---|---|---|---|
| 7,178,972 | B2 * | 2/2007 | Owen | E01C 21/00 366/16 |
| 7,908,062 | B2 * | 3/2011 | Corcoran | E02F 9/2045 701/50 |
| 8,333,333 | B2 * | 12/2012 | Embry | E21F 5/02 239/159 |
| 8,511,933 | B2 * | 8/2013 | Menzenbach | E01C 19/2025 404/108 |
| 9,234,317 | B2 * | 1/2016 | Chi | E01C 19/288 |
| 2007/0239336 | A1 * | 10/2007 | Congdon | E01C 19/288 701/50 |
| 2007/0260379 | A1 * | 11/2007 | Congdon | E01C 21/00 701/50 |
| 2008/0003057 | A1 * | 1/2008 | Hall | E01C 19/22 404/84.1 |
| 2010/0202832 | A1 * | 8/2010 | Menzenbach | E01C 19/025 404/91 |
| 2010/0209189 | A1 * | 8/2010 | Menzenbach | E01C 19/2025 404/91 |
| 2010/0316445 | A1 * | 12/2010 | Kasahara | E01C 23/065 404/77 |
| 2011/0170953 | A1 * | 7/2011 | Diamond | B09C 1/02 405/128.75 |
| 2014/0270953 | A1 * | 9/2014 | Duffy | E01C 19/48 404/75 |
| 2014/0308073 | A1 * | 10/2014 | Delius | E01C 19/288 404/72 |
| 2015/0088785 | A1 * | 3/2015 | Chi | E02D 3/00 706/11 |
| 2016/0054283 | A1 * | 2/2016 | Stromsoe | E02D 1/02 73/488 |
| 2018/0126592 | A1 * | 5/2018 | Karam | B28C 9/002 |

* cited by examiner

Fig. 2 (A, B)
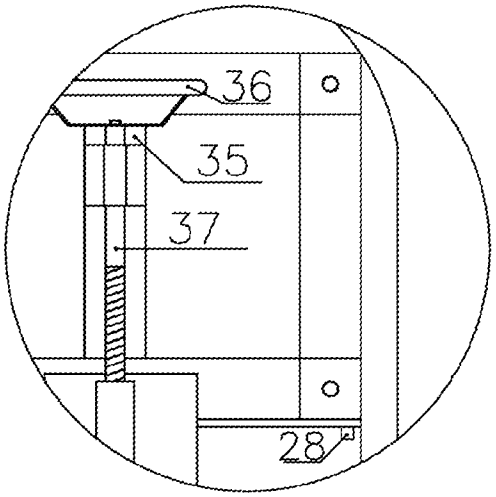
A
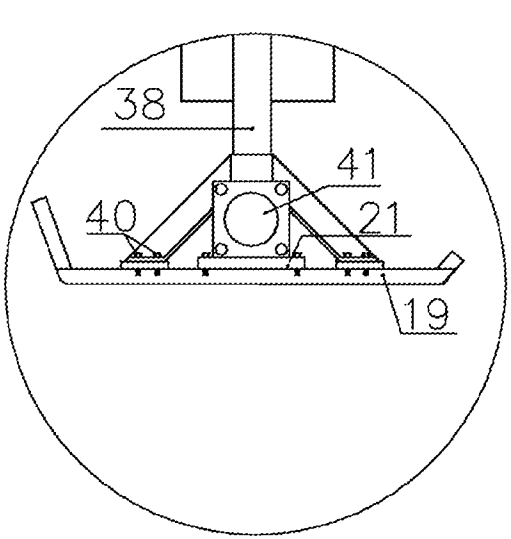
B

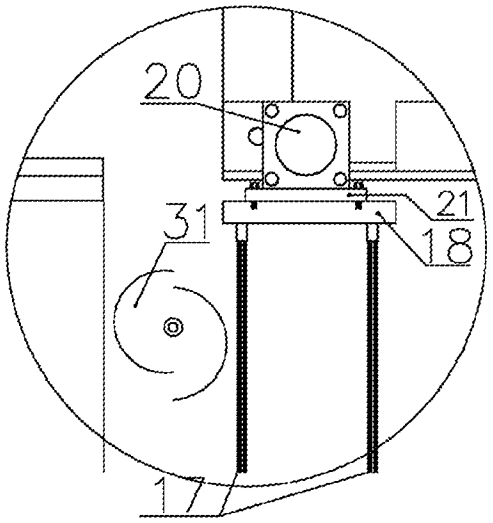
D
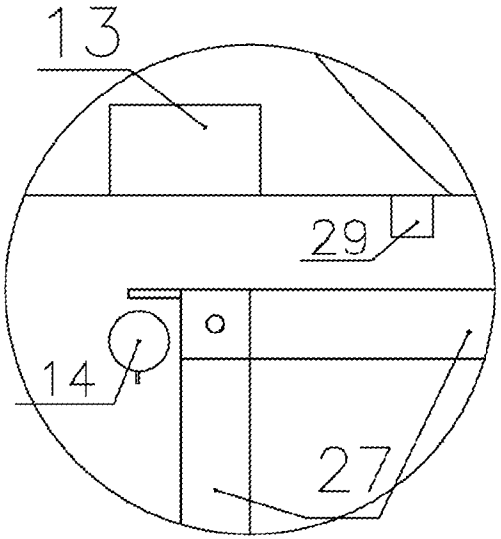
C
Fig. 2 (C, D)

LEVELING, TUNE-UP AND COMPACTING DEVICE

BACKGROUND OF THE INVENTION

Although the grader has been used in many different earthworks, for instance, road construction, land escaping and dam construction for a long time, and a number of methods and techniques for spreading and leveling embankment have been developed and are part of the prior art, low efficiency and slowness remained unchanged as its drawbacks. However, this invention handles the problem of time and cost and provides more efficiency as well.

SUMMARY OF THE INVENTION

Earthworks, in particular road construction require the employ of the wide range of machineries from heavy to light; such as: bulldozers, excavator and loader for excavation and loading; grader, scraper, roller and sprinkler trucks for leveling; dump trucks for carrying the soil; and busses, minibuses and different cars as a light machine for the transportation of workers.

Low efficiency and slowness of the grader and the roller in comparison with the other machineries which are employed in road construction lead to rising the operation time and the costs of project. The present invention addressed these deficiencies by the distributing, tune-up and leveling machine of embankment which can increase efficiency and decrease the costs of project as well as operation time at any earthwork projects.

Distributing, tune-up and leveling machine of embankment (this invention) is a machine that can fulfill the expectations of contractors and earthworks operators especially in road construction area. This apparatus accelerates the implementation process by eliminating grader and merging the distinct and time-consuming operations which are classified below:

1. Digging, loading and depot of materials during the operations by bulldozers, loaders and trucks
2. Distributing and rigging out materials by grader
3. Water spraying the granules of materials by sprinkler trucks
4. Leveling, tune-up and compacting layers by grader and roller Implementing above operations simultaneously causes to prevent significant costs due to the nonuse of machineries and save time as a key feature.

BRIEF DESCRIPTION OF DRAWINGS

FIG. 2 (A-D) is a blow up view of section A, B, C and D in FIG. 1.

DETAILED DESCRIPTION OF THE INVENTION

Figure 1:
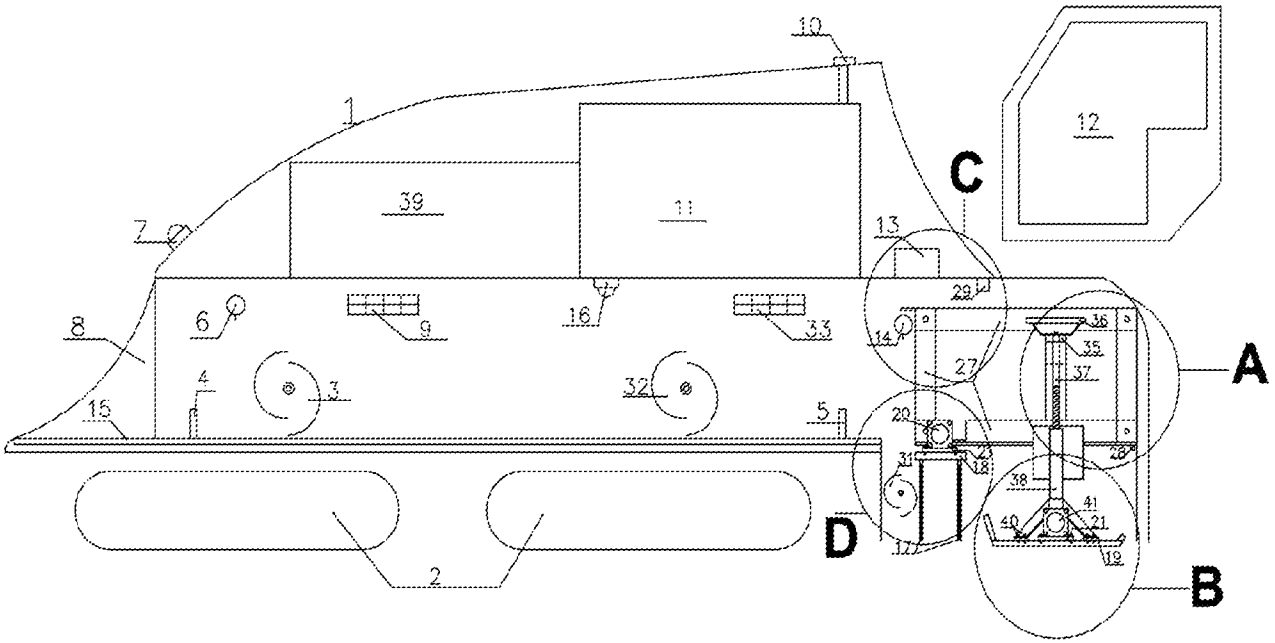
FIG. 1 is a longitudinal section of the present apparatus.
Figure 3:
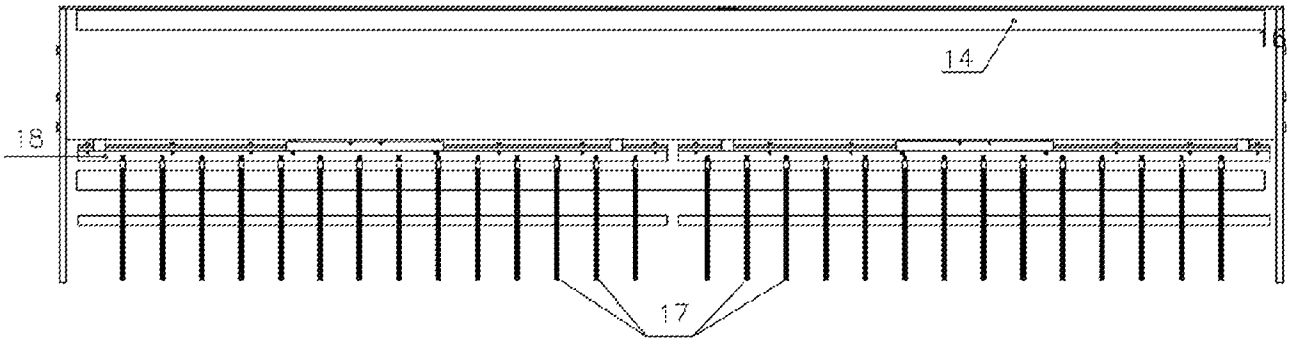
FIG. 3 is a front view of the Screed.
Figure 4:
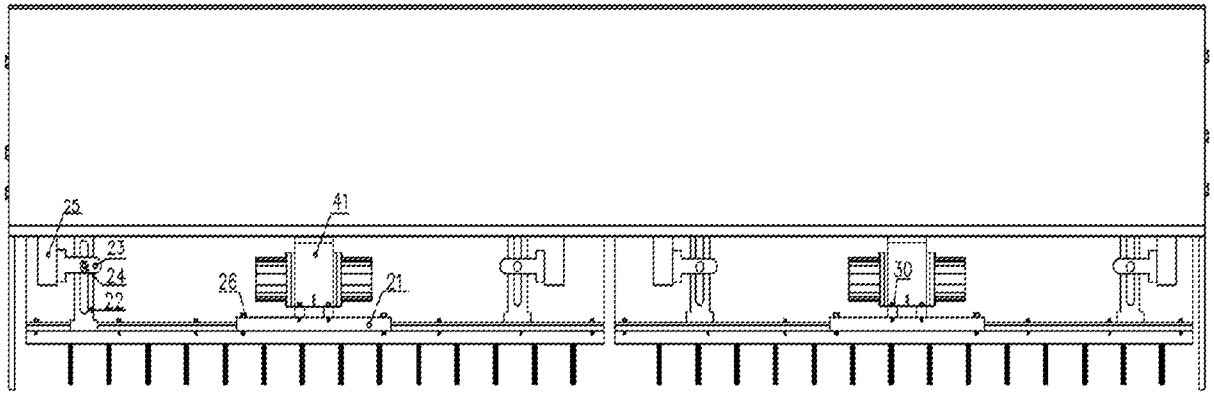
FIG. 4 is a back view of the screed.
Figure 5:
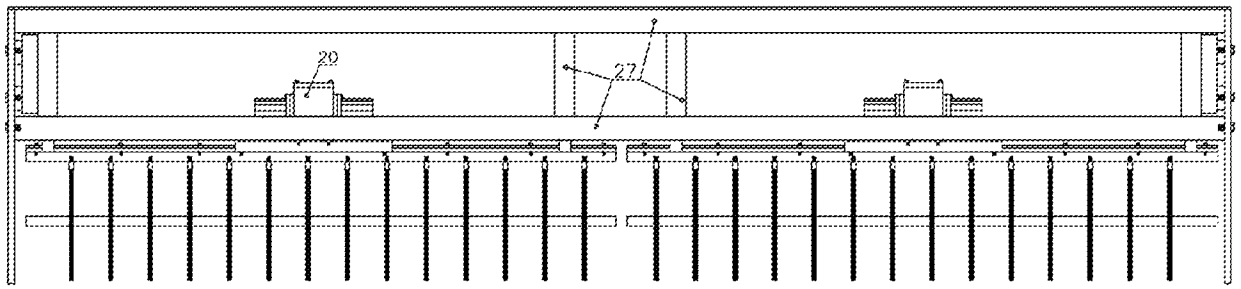
FIG. 5 is a view of rake bars (17), rake sole vibrator (20), screed chassis (27).
Figure 6:
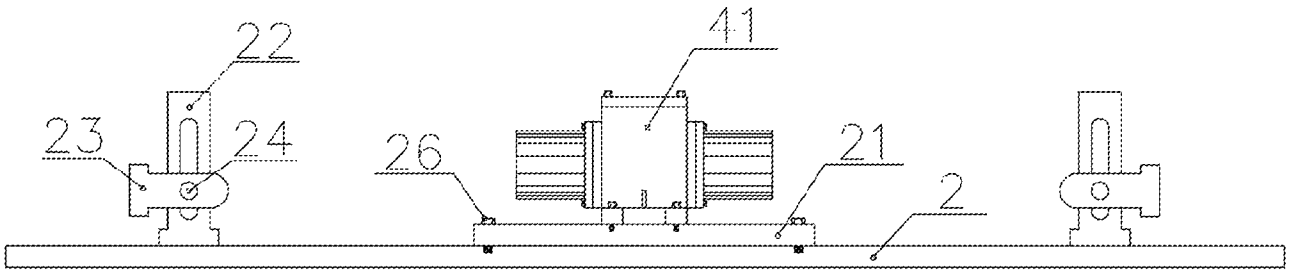
FIG. 6 is the transverse section of the screed.
Figure 7:
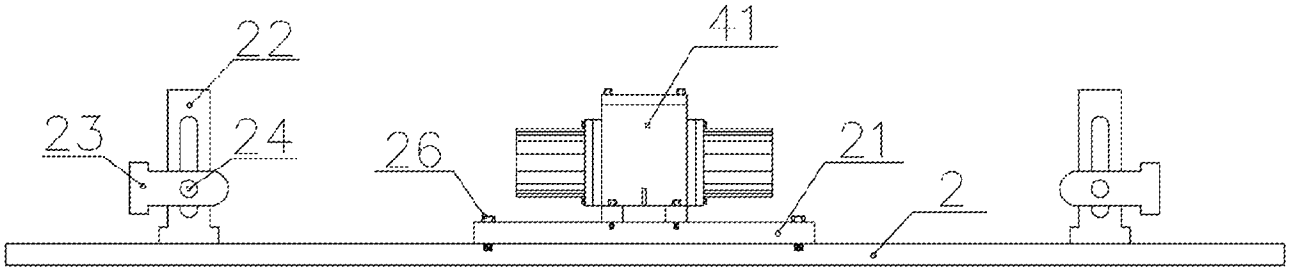
FIG. 7 is the position of the pieces on the leveling sole.
Figure 8:
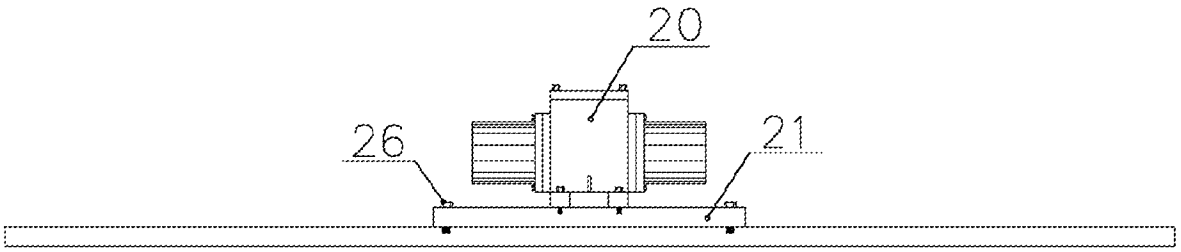
FIG. 8 is the position of the pieces on the rake sole.
Figure 9:
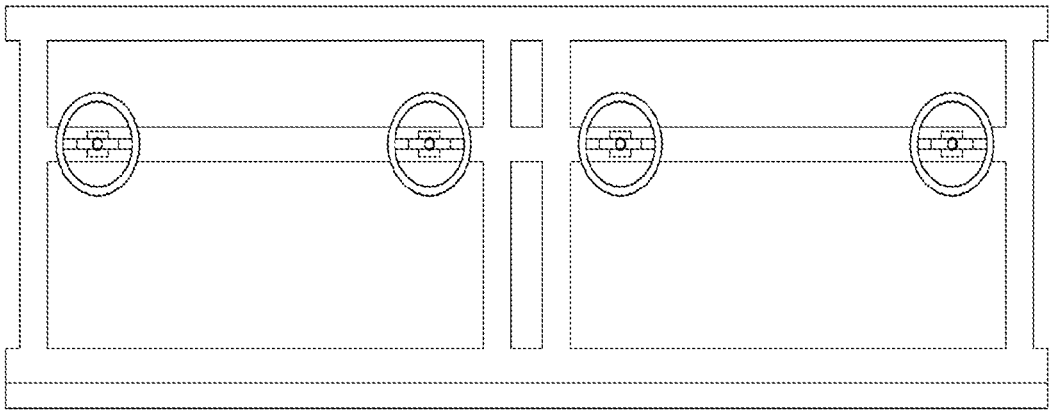
FIG. 9 is the position of the steering (36), high regulator bar in manual mode.
Figure 10:
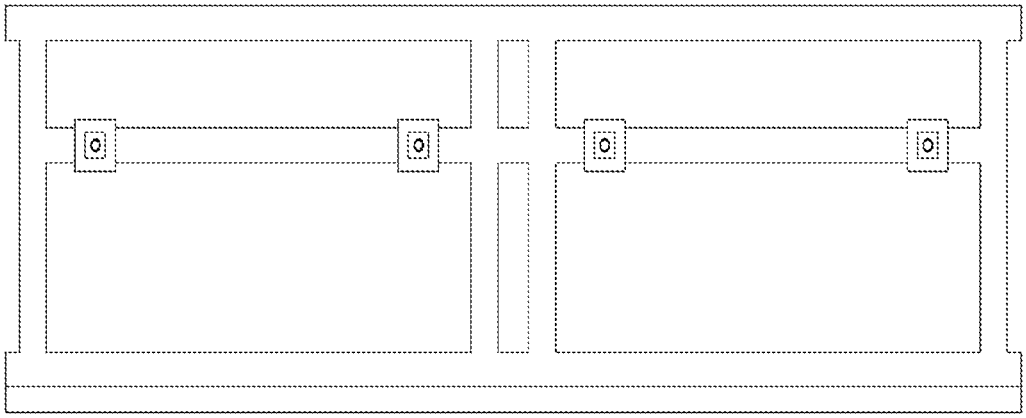
FIG. 10 is the position of the hydraulic engine (42), high regulator bar in the automatic mode.
Figure 11:
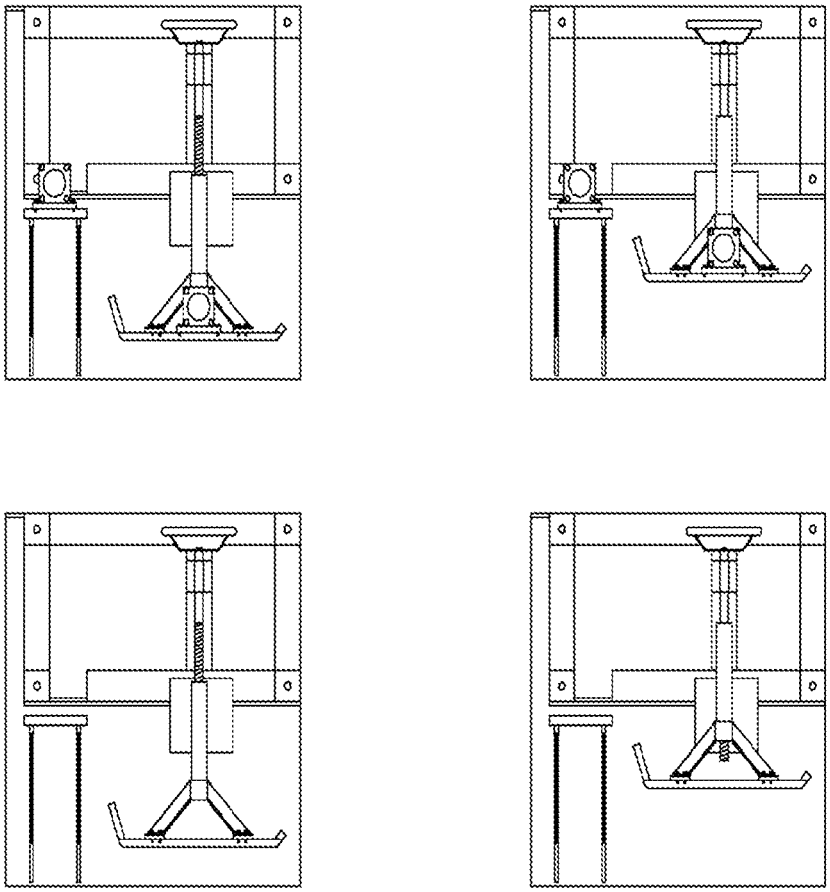
FIG. 11 is a perspective view of the screed operation in manual mode with the steering for lifting the leveling sole up and dawn
Figure 12:
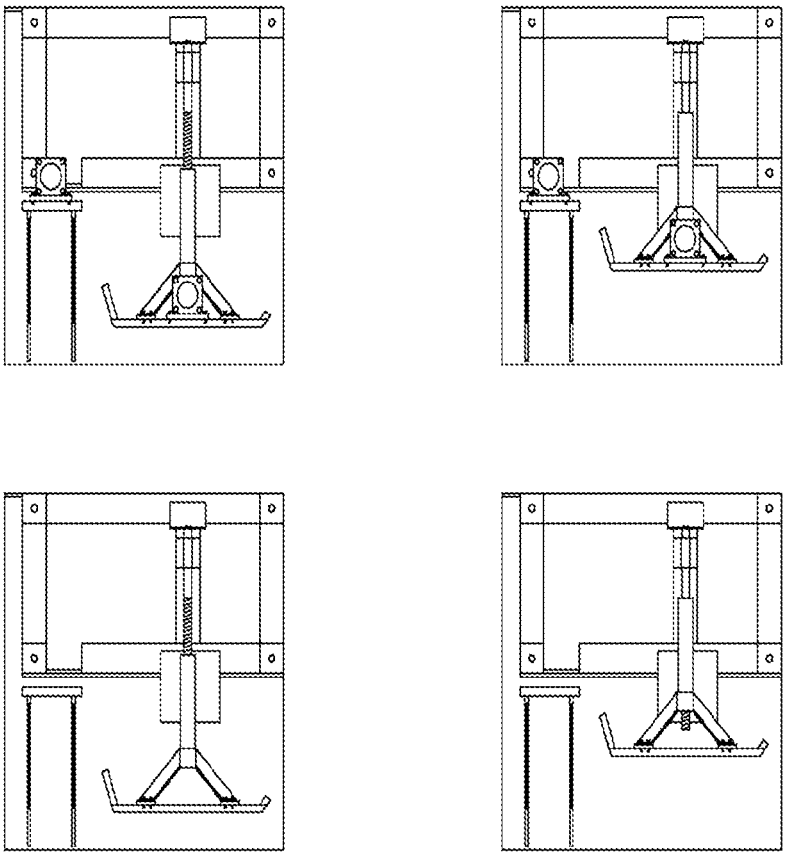
FIG. 12 is a perspective view of the screed operation in automatic mode with hydraulic engine for lifting the leveling sole plate up and dawn.

One of the problems in road construction which puts each project in trouble in terms of timing and cost is grader and roller machinery and providing that is trouble making for contractors. If a contractor wants to buy this machinery, because old used machinery creates high maintenance costs and possibility of numerous stops at work so it is not economically worth, he has to buy the new one, as result he has to spend heavy costs for investments in order to buy above ones. To compensate this cost, contractor has to finish almost many projects for these machines to be in profitability phase.

With current trend of performing projects and necessary time to accomplish these projects, work hours of systems will reach that much which make them to be serviced and as result repairing will cost again. Above problems and several years of work experience in road projects make me find a method for faster implementation of projects. This multi-year effort led to invent this system and machine. This system is based on Vibration, galvanizing and compression of consumption materials seed together in levee layer.

LIST OF ALL THE APPARATUS PARTS

1 Body
2 Track
3 Material mixer
4 Primary moisture measuring section
5 Secondary moisture measuring section
6 Primary sprinkler pipe
7 Incoming material camera
8 Incoming material inlet
9 Aspirators
10 Water tank inlet
11 Water tank
12 Operator's cabin
13 Sprinkler engine
14 Secondary sprinkler pipe
15 material driving sole plate
16 Operation control camera
17 Rake bars
18 Rake level/floor
19 Leveler floor
20 Rake vibrator
21 Leveler and rake vibrator connecting plate
22 Rake height adjustment stand???
23 Height adjustment fixator
24 Fixator screw
25 Fixator stand
26 Leveler and vibrator connecting plate Screw
27 Screed chassis
28 Laser sensor for soil altimeter
29 GPS
30 Mounting screw of vibrator to connection plate
31 Material distributor
32 Secondary mixer
33 Secondary aspirator
35 Height regulator bar lock

36 Steering wheel
37 Height regulator bar
38 Height regulator bar pod
39 Diesel engine
40 Fixing screw of the height regulator pod to leveler plate
41 Vibrator of the leveler plate
42 Hydraulic engine of the height regulator bar One of the problems in road construction which creates issues in terms of time and cost; is the grader and the roller. Since old used machineries create high maintenance costs and have a high possibility of numerous interrupts in the operations and they are not economical, contractors have to pay heavy costs to buy new ones.

To recover these expenses, they have to finish almost many projects by these machines, while present process of operations leads to the early depreciation of machineries that will entail service and repairing costs. Above problems and several years of experience in road construction projects lead us to create faster and more reliable machinery for implementation of projects.

All materials are uploaded on the front body part of the machine (1) which moves on track (2) and from there are directed to inlet port (8). Then the materials are carried into the machine by materials driving sole plate (15). The moisture of soil is measured by initial moisture measuring means (4). Then the soil is sprinkled with water by initial sprinkler pipe (6) if the moisture measuring means (4) detects low humidity or lack therefor in the soil.

Materials are mixed with water two times, first by an initial material mixer (3) and finally by a secondary mixer (32) to ensure that the mixture of water and soil has been done well. Entry of materials into the system is controlled by the operator and the incoming materials' controlling camera (7). The mixing operation is also supervised by the operator via an operation controlling camera (16).

Initial aspirator (9) and the secondary aspirator (33) gathers dust created in the mixing operation, this leads to improvement of the operation of both material and operation controlling cameras (7 and 16). Following that, the moisture of soil is measured again by secondary moisture measuring means (5), if the moisture of soil is not optimal; it is sprinkled again by secondary sprinkler pipe (14).

Required water of the machine enters through water tank (11) by water tank inlet (10) and is transferred to the initial sprinkler pipe (6) and the secondary sprinkler pipe (14) by sprinkler engine (13). For better operation and maintaining on the direction coordinates, the system is controlled by GPS (29). The whole operation is controlled by operator inside the driver cabin (12). More importantly, the cabin can also be placed and fixed on the right and/or left side of the machine by rotating its leg.

In this step, moist soil is transferred towards the rake bars (17) by materials distributor (31) and is vibrated to move the soil next to each other and therefore merging them together and creating an even layer of soil. The vibration of rake bars (17) is provided by the rake sole vibrator (20) that is installed on the connection plate of vibrator and sole (21) by vibrator mounting screw (30) and both are installed on rake sole (18) by vibrator and sole connection plate screw (26).

Considering that whole systems is moving forward, so rake bars (17) through creating vibration while passing compress soil and prepare it for pummeling and compacting by leveling sole (19). The vibration and pressure of leveling sole (19) is created either by leveling sole vibrator (34) that is connected to the vibrator and sole connection plate (21) by vibrator mounting screw to connection plate (30) and they are also braced to leveling sole (19) by vibrator and leveling sole mounting screw to connection plate (26).

The eligible height for embankment layer can be provided through two methods: a) manual method, b) computer method.

a) In manual system, operator by opening a fixator screw of a regulator stand (24) and opening a lock of a height regulator bar (35) and rotating a steer (36) of the height regulator bar (37) which is connected to the leveling sole (19) by regulator bar pod (38) and by screw (40) for lifting leveling sole up and dawn (19) that is connected by sole height regulator stand (22) to regulator stand fixator (23) and obtain desired height. For preventing height changes during operation, regulator stand fixator (23) are installed on fixator stand (25) and height regulator bar lock (35) has been considered.
b) Eligible height is identified in this method through system computer and layer height regulator laser sensor (28) and is stabilized by engine (42) which is installed instead of steering (36) and move height regulator stand (37). In laser method, regulator stand fixator screw is opened and closed by computer and hydraulically.

The power required of this machine is provided out of engine (39). After passing leveling sole (19) from poured layer and soil compression in each other, it can be ensured that layer density of backfill has been provided well and the rest of required density will be achieved by rollers. This machine can be used in all earthwork operation such as rock foil, planning layer, the basis and foundation in road construction projects, landscaping, airports and dams.

Dimensional Features of the Machine Are as Follows

Screeding (Layer planning) of width 1 m to 16 m and a thickness of 10 cm to 60 cm Dimensions of machine in screeding in the smallest size are 1.2 m length, 60 cm width, 70 cm height and in the maximum size are 16 m length, 1.5 m width, 1.3 m height.

Water tank capacity of 1.5 cubic meters to 9 cubic meters depending on kind of the machine.

The monitor of machine is LED and all operations are done touch. Operation can be also controlled by keys in case of customer request.

Installed cameras are with HD quality and of the best brand available in the market with the highest resolution.

The machines with screeding in width from 4.5 meter and higher, have two leveling plates standardly and in case of customer request, small machine can also have two leveling plates.

Lifting leveling plates up and dawn can be electrically, hydraulically, manually or the combination of them based on customer request.

System computer saves all done operations and information during the process of screeding including the memories of the system cameras, the percentage of initial moisture, the rate of added water, the percentage of secondary moisture, the rate of pressure on soil in order to compressing layers, layer length, width and thickness, longitudinal and transverse profiles of path has been implemented to control the volume of materials which are used during a work shift for proposing to people or authorities.

Operator cabin of system can be moved from right to left or vice versa on rails which are devised behind the machine or by hydraulic arms.

Some Advantages of this Invention

1) High speed operation for embankment of many different layers.

2) Significantly reducing operation time of earthworks projects.
3) Reduction of used fuels in the project due to the dramatic reduction of project time.
4) Significantly reducing current costs of workshop associated with personnel salary and food.
5) The possibility of creating layers with a more width at any embankment.
6) Creating a layer with the desired or required thickness.
7) Low maintenance costs.

According to required capacity, this machine can have different dimensions and various engines with different powers to be able to meet different kinds of users' needs related to earthwork projects.

The invention claimed is:

1. A method of leveling, tune-up and compacting comprising the steps of:

a) loading all materials on a front body of a leveling machine that moves on a track;
b) directing and loading said materials into an inlet port;
c) guiding and controlling entry of said materials inside said machine via a driving sole plate and a controlling camera;
d) measuring a moisture of said soil by an initial moisture measuring means;
e) detecting/measuring humidity level of said soil and spraying and sprinkling said soil with water if said initial moisture measuring means detects low humidity or lack thereof in said soil
f) mixing all of said materials with said water at a first time by an initial material mixture;
g) controlling said mixing via an operation controlling camera;
h) gathering a first amount of created dust in said initial material mixer via an initial aspirator;
i) measuring said moisture of said soil in said materials at a second time via a secondary moisture measuring means;
j) detecting/measuring said humidity level of said soil;
k) spraying/sprinkling said materials with said water via a secondary sprinkler pipe, if said humidity level measurement is not optimal;
l) mixing all of said materials secondly by a secondary mixer and therefore creating moist soil; and
m) gathering a secondary amount of created dust in said secondary mixer via a secondary aspirator.

2. The method of claim 1, wherein said steps of mixing said water with said soil is controlled by said controlling camera.

3. The method of claim 2, wherein said water is stored in a water tank, and is guided to said initial and secondary sprinklers through a water tank inlet by a sprinkler engine.

4. The method of claim 3, further comprising the step of transferring moist soil towards rake bars by a material distributer; wherein said distributer creates vibration to move said soil next to each other and therefore merging them together creating an even and compressed layer of said moist soil.

5. The method of claim 4, wherein said vibration of said rake bars is provided by a rake soil vibrator that is installed on a connection plate of said vibrator and a leveler and rake vibrator connecting plate.

6. The method of claim 5, wherein said compressed soil is pressed by a leveling sole vibrator that is connected to said vibrator and a sole connecting plate.

7. The method of claim 6, wherein desired height for an embankment layer is provided through manual and automatic methods; wherein in said manual method a leveling sole is lifted up and down by opening a fixator screw of a regulator stand and opening a lock of a height regulator bar and rotating a steer of said height regulator bar; wherein said height regulator bar is connected to said leveling sole; and therefore said desired height is achieved and locked in place via a height regulator bar lock.

8. The method of claim 7, wherein in said automatic method said desired height is achieved via a system computer and layer height regulator laser sensors; wherein said computer controls opening and closing of screws for a regulator stand fixator and therefore moving a height regulator stand in order to adjust said height.

* * * * *